US007448988B2

(12) United States Patent
Taylor

(10) Patent No.: US 7,448,988 B2
(45) Date of Patent: Nov. 11, 2008

(54) EXERCISE APPARATUS

(76) Inventor: Clifton T. Taylor, 1550 Ozora Rd., Loganville, GA (US) 30052

( * ) Notice: Subject to any disclaimer, the term of this patent is extended or adjusted under 35 U.S.C. 154(b) by 0 days.

(21) Appl. No.: 11/852,563

(22) Filed: Sep. 10, 2007

(65) Prior Publication Data

US 2008/0096734 A1 Apr. 24, 2008

Related U.S. Application Data

(60) Provisional application No. 60/825,108, filed on Sep. 8, 2006.

(51) Int. Cl.
*A63B 21/08* (2006.01)

(52) U.S. Cl. ..... 482/97; 482/92; 482/133; 482/50

(58) Field of Classification Search ..... 482/44, 482/49–50, 92–94, 97, 133, 135–137, 905; 601/40

See application file for complete search history.

(56) References Cited

U.S. PATENT DOCUMENTS 632,114 A 8/1899 Hendrickson
2,819,081 A 1/1958 Touraine
3,570,840 A 3/1971 Sather et al.
3,570,849 A 3/1971 Ratchford
RE28,845 E 6/1976 Ratchford ..... 272/67
4,226,412 A 10/1980 Panepinto ..... 272/68
4,240,624 A 12/1980 Wilson ..... 272/68
4,251,071 A 2/1981 Norton ..... 272/137
4,262,898 A 4/1981 Lee ..... 272/68
4,291,871 A 9/1981 Lippert ..... 272/68
4,336,934 A * 6/1982 Hanagan et al. ..... 482/73
4,494,751 A 1/1985 Schnell ..... 272/117
4,513,962 A 4/1985 Robson et al. ..... 272/68
4,553,746 A 11/1985 Lee ..... 272/68
4,598,907 A 7/1986 Ross ..... 272/117
4,621,810 A 11/1986 Cummins ..... 272/134
4,623,141 A 11/1986 Salvino ..... 272/68
4,634,114 A 1/1987 Garcia ..... 272/67
4,674,160 A * 6/1987 Gibson ..... 482/97
4,691,918 A 9/1987 Rockwell ..... 272/134
4,743,018 A 5/1988 Eckler ..... 272/123
4,783,067 A 11/1988 Palmer ..... 272/68
4,830,361 A 5/1989 Hoffman ..... 272/68
4,886,073 A 12/1989 Dillon et al. ..... 128/774
4,949,951 A 8/1990 Deola ..... 272/134
4,984,784 A 1/1991 Bailey ..... 272/67
5,046,725 A 9/1991 Brennan ..... 272/118
5,060,933 A 10/1991 Cedro ..... 272/67
5,060,934 A 10/1991 Winston ..... 272/68

(Continued)

*Primary Examiner*—Fenn C. Mathew
*Assistant Examiner*—Andrew M Tecco
(74) *Attorney, Agent, or Firm*—Ballard Spahr Andrews & Ingersoll, LLP

(57) ABSTRACT

An exercise apparatus having a base, a frame mounted thereon the base, and a weight assembly. The frame has a first handle that extends upwardly and is spaced above the base. In one aspect, the weight assembly has at least one weight rack for the temporary mounting of exercise weights thereon and a second handle that extends upwardly away from the weight rack. In this aspect, the weight assembly is pivotally connected to the frame at a first pivot point and is configured to articulate about and between a first position in which the second handle is spaced from the first handle and a second position in which the second handle is substantially adjacent the first handle.

13 Claims, 4 Drawing Sheets

U.S. PATENT DOCUMENTS 5,078,388 A 1/1992 Dempsey ..... 272/67
5,080,349 A 1/1992 Vittone ..... 272/123
5,087,032 A 2/1992 Gresh ..... 272/68
5,125,878 A 6/1992 Wingate et al. ..... 482/49
5,184,991 A * 2/1993 Brangi ..... 482/97
5,207,624 A 5/1993 Paskovich ..... 482/93
5,222,925 A 6/1993 Maycock et al. ..... 482/44
5,281,192 A 1/1994 Nelson ..... 482/44
5,312,309 A 5/1994 Fox ..... 482/45
5,344,374 A 9/1994 Telle ..... 482/97
5,372,557 A 12/1994 Ostigny ..... 482/49
5,380,259 A 1/1995 Robertson et al. ..... 482/44
5,413,546 A 5/1995 Basile ..... 482/99
5,496,244 A 3/1996 Caruthers ..... 482/108
5,505,680 A 4/1996 Keith ..... 482/92
5,556,359 A 9/1996 Clementi ..... 482/49
5,580,336 A 12/1996 Coallier ..... 482/44
5,597,375 A 1/1997 Simonson ..... 482/100
5,599,256 A 2/1997 Hughes, Jr. ..... 482/49
5,611,755 A 3/1997 Blackmore ..... 482/49
5,637,063 A * 6/1997 Fuller, Sr. ..... 482/97
5,667,464 A 9/1997 Simonson ..... 482/97
5,698,782 A 12/1997 Gledhill ..... 73/379.03
5,833,580 A 11/1998 Chiu ..... 482/49
5,868,654 A 2/1999 Norian ..... 482/140
5,897,473 A 4/1999 Koenig ..... 482/97
5,913,749 A 6/1999 Harmon ..... 482/49
5,947,871 A 9/1999 Gilcrease ..... 482/49
5,957,813 A 9/1999 Macdonald ..... 482/44
5,957,817 A * 9/1999 Koenig et al. ..... 482/72
6,007,460 A 12/1999 Young ..... 482/49
D418,561 S 1/2000 Cousins ..... D21/684
6,022,300 A 2/2000 Hightower ..... 482/106
6,179,757 B1 1/2001 Koenig ..... 482/97
6,241,637 B1 6/2001 Basyuk ..... 482/44
6,312,365 B1 11/2001 Koenig ..... 482/97
6,336,894 B1 1/2002 Kestila ..... 482/99
6,358,189 B1 3/2002 Koenig ..... 482/97
6,361,481 B1 3/2002 Koenig ..... 482/97
6,394,937 B1 5/2002 Voris ..... 482/139
6,406,406 B1 6/2002 Onorati ..... 482/44
6,443,874 B1 * 9/2002 Bennett ..... 482/44
6,468,188 B1 * 10/2002 Koenig ..... 482/97
6,471,624 B1 10/2002 Voris ..... 482/142
6,475,123 B1 11/2002 Evans ..... 482/97
6,475,126 B1 11/2002 Hay, Jr. ..... 482/131
6,575,881 B2 * 6/2003 Lapcevic ..... 482/97
6,726,599 B1 4/2004 Stonecipher ..... 482/44
6,736,765 B2 5/2004 Wallace et al. ..... 482/106
6,746,373 B1 6/2004 Bohmer ..... 482/44
6,860,840 B2 3/2005 Carter ..... 482/97
6,918,862 B1 7/2005 Comeau ..... 482/111
6,942,601 B2 9/2005 Chuang et al. ..... 482/44
6,976,941 B2 12/2005 Britt ..... 482/94
6,979,285 B2 12/2005 Lovison ..... 482/95
6,994,660 B2 2/2006 Ish, III et al. ..... 482/98
7,014,600 B2 3/2006 Johnson ..... 482/140
D521,086 S 5/2006 Faulconer ..... D21/684
7,037,240 B2 5/2006 Pemberton ..... 482/49
2001/0019986 A1 9/2001 Cook ..... 482/105
2002/0028733 A1 3/2002 Martens ..... 482/99
2002/0045520 A1 * 4/2002 Lapcevic ..... 482/97
2002/0137599 A1 9/2002 Kuo ..... 482/45
2002/0187883 A1 12/2002 Lovison ..... 482/108
2003/0004041 A1 1/2003 Hartman et al. ..... 482/106
2003/0134729 A1 7/2003 Baltodano ..... 482/121
2004/0157713 A1 8/2004 Kweon ..... 482/144
2004/0198568 A1 10/2004 Stonecipher ..... 482/106
2005/0177982 A1 8/2005 Parlante ..... 16/422
2006/0063647 A1 3/2006 Jones-Glaser ..... 482/49
2006/0079380 A1 4/2006 Wells ..... 482/49

* cited by examiner

EXERCISE APPARATUS

This application claims priority to and the benefit of U.S. Application No. 60/825,108, which was filed on Sep. 8, 2006.

FIELD OF THE INVENTION

The present invention relates generally to an exercise machine, and more particularly to a grip strength exercise apparatus for use predominantly by power weight lifters.

BACKGROUND OF THE INVENTION

Power weight lifters employ various machines and methods to strengthen their bodies. One of the most difficult areas to target is the forearms. Current solutions employ single hand devices using a variety of springs and synthetic materials to bias two levers away from each other. Such devices exert variable forces through the travels of the levers and are not representative of free weight training. Other solutions use levers employing weight multiplying moment arms which do not allow the individual to know the precise weight that he or she is lifting, which is critical in competitive weight training.

The previous solutions for grip strength training may not adequately address the need for very large weights required by power weight lifters. While individuals may choose to exercise one hand at a time, there is still a need for a machine that will train both hands at once and accommodate different size hands, as well. Weight trainers typically track their progress based on very small, incremental increases over time. A free weight system is ideal for such a program of training.

SUMMARY

The present invention pertains to an exercise apparatus having a base, a frame mounted thereon the base, and a weight assembly. The frame has a first handle that extends upwardly and is spaced above the base.

In one aspect, the weight assembly has at least one weight rack for the temporary mounting of exercise weights thereon and a second handle that extends upwardly away from the weight rack. In this aspect, the weight assembly is pivotally connected to the frame at a first pivot point and is configured to articulate about and between a first position in which the second handle is spaced from the first handle and a second position in which the second handle is substantially adjacent the first handle. In effect, the user would grip both handles simultaneously and open and close his grip to move the weight assembly to and from the first position to the second position. In this aspect, the second handle moves along an arc that is in a plane that bisects and is substantially normal to the base longitudinal axis. The second handle, in one aspect, moves along a continuous compound arc of increasing radius of curvature.

DETAILED DESCRIPTION OF THE DRAWINGS

These and other features of the preferred embodiments of the present invention will become more apparent in the detailed description, in which reference is made to the appended drawings wherein.

DETAILED DESCRIPTION OF THE INVENTION

Figure 1:
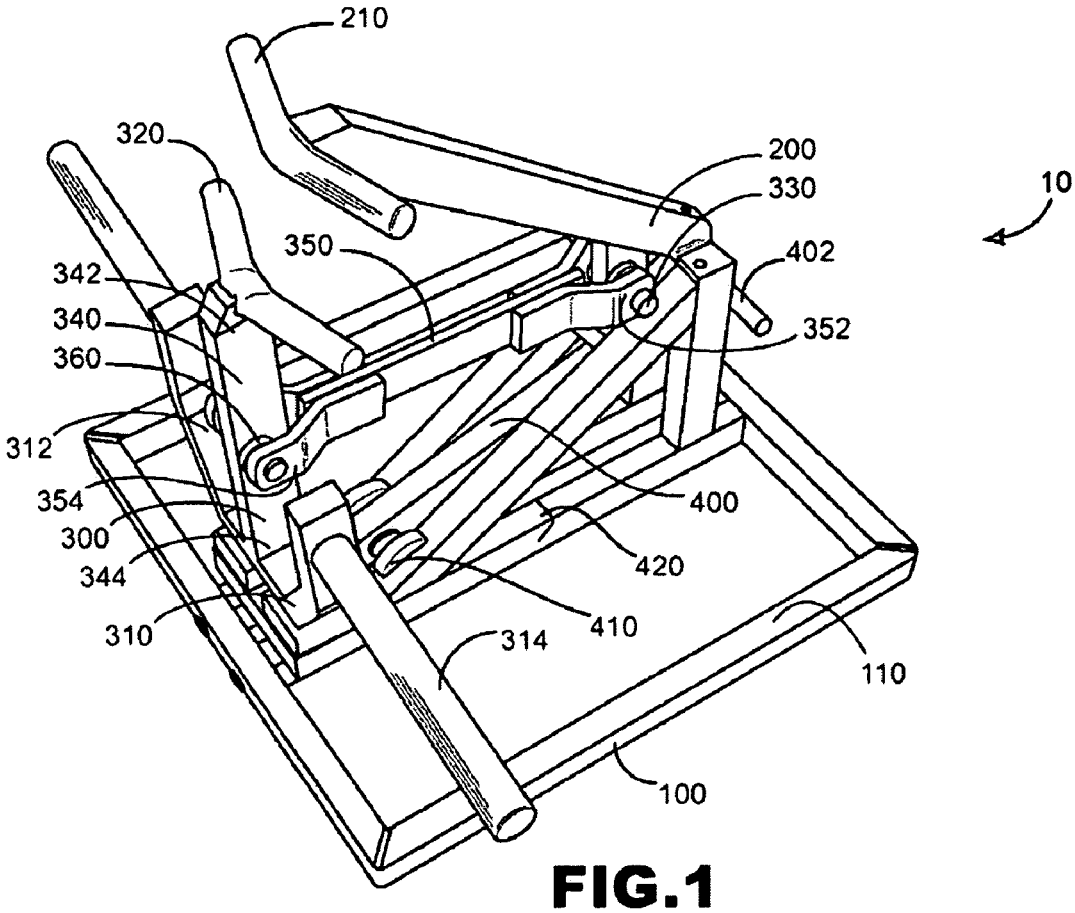
FIG. 1 is a top perspective view of the exercise apparatus of the present invention.
Figure 2:
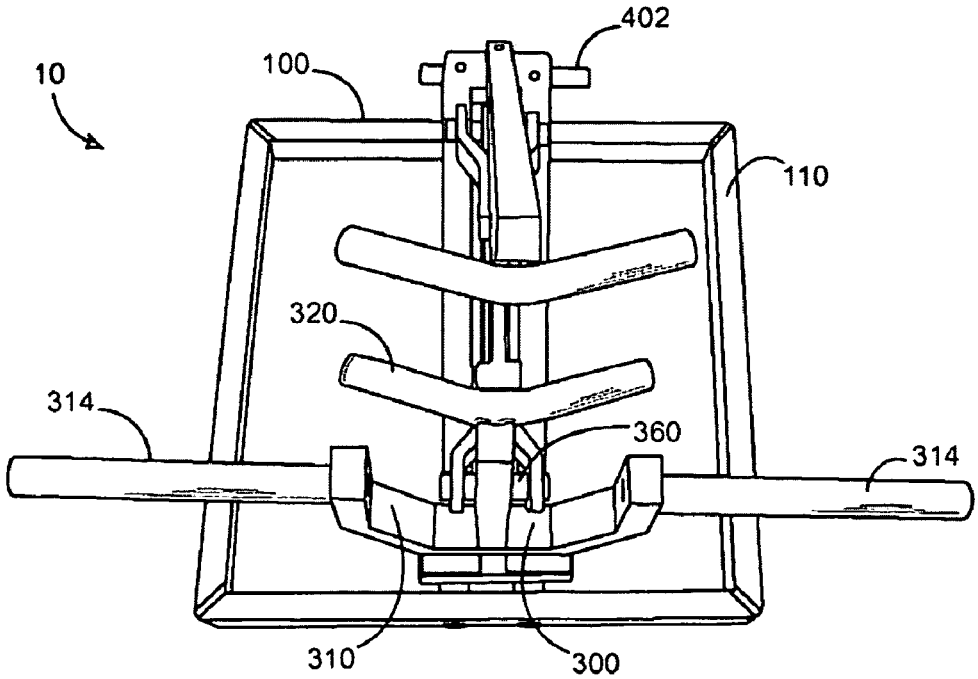
FIG. 2 is top elevational view of the exercise apparatus of FIG. 1.
Figure 3:
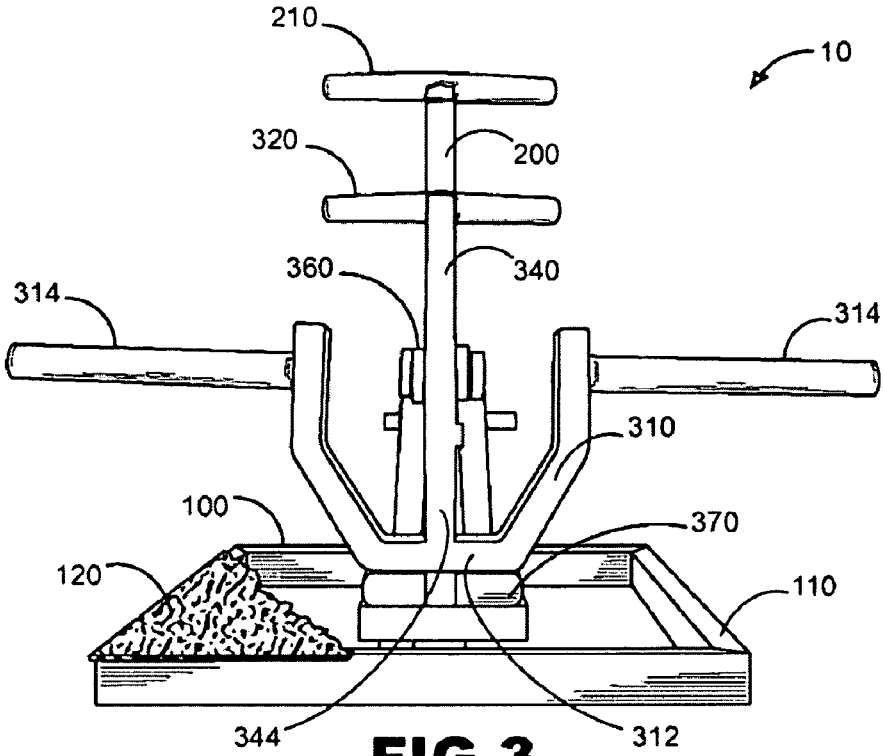
FIG. 3 is a front elevational view of the exercise apparatus of FIG. 1.
Figure 4:
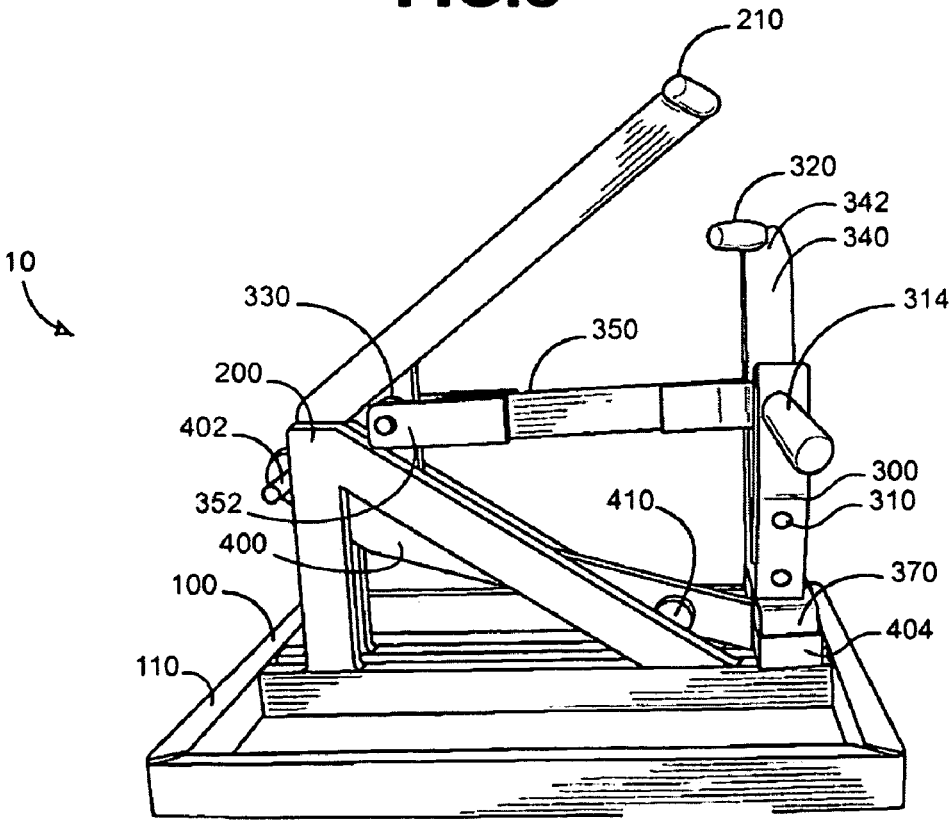
FIG. 4 is a left side elevational view of the exercise apparatus of FIG. 1, the right, opposite side, is a mirror image thereof.
Figure 5:
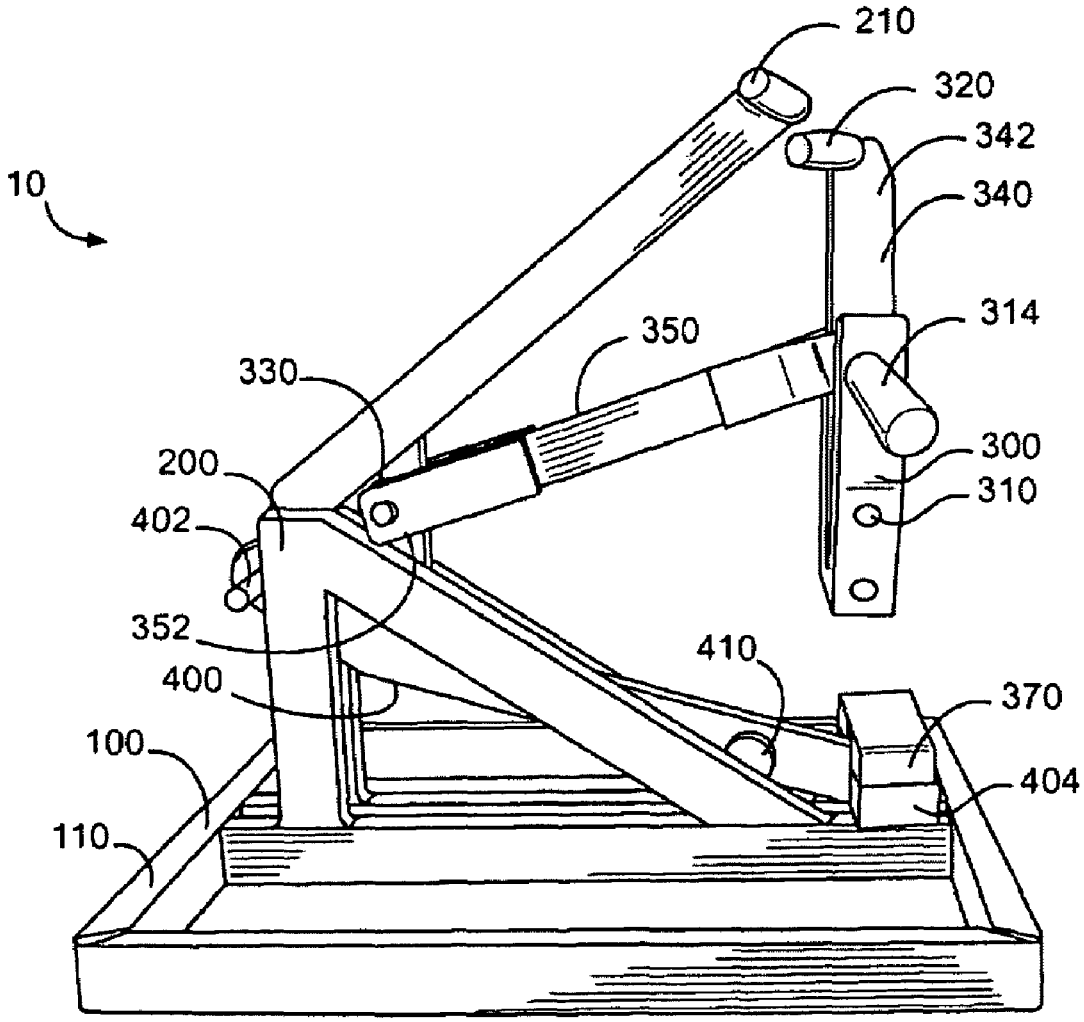
FIG. 5 is a left side elevational view of the exercise apparatus of FIG. 1, showing the weight assembly in the up position and the second handle in second position.

Before the present articles, devices, assemblies and/or methods are disclosed and described, it is to be understood that this invention is not limited to the specific articles, devices, assemblies and/or methods disclosed unless otherwise specified, as such may, of course, vary. It is also to be understood that the terminology used herein is for the purpose of describing particular embodiments only and is not intended to be limiting.

As used herein, the singular forms "a," "an" and "the" include plural referents unless the context clearly dictates otherwise. The embodiments are described with reference to the figures, in which like numbers indicate like parts throughout the figures.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

The invention is an exercise apparatus 10, having a base 100, a frame 200 mounted thereon the base 100, and a weight assembly 300. The frame 200 has a first handle 210 that extends upwardly and is spaced above the base 100.

In one aspect, the weight assembly 300 has at least one weight rack 310 for the temporary mounting of exercise weights thereon and a second handle 320 that extends upwardly away from the weight rack 310. In this aspect, the weight assembly is pivotally connected to the frame 200 at a first pivot point 330 and is configured to articulate about and between a first position $P_1$ in which the second handle 320 is spaced from the first handle 210 and a second position $P_2$ in which the second handle is substantially adjacent the first handle. In effect, the user would grip both handles 210 and 320 simultaneously and open and close his grip to move the weight assembly to and from the first position $P_1$ to the second position $P_2$. In this aspect, the second handle 320 moves along an arc that is in a plane that bisects and is substantially normal to the base longitudinal axis $L_B$.

Figure 6:
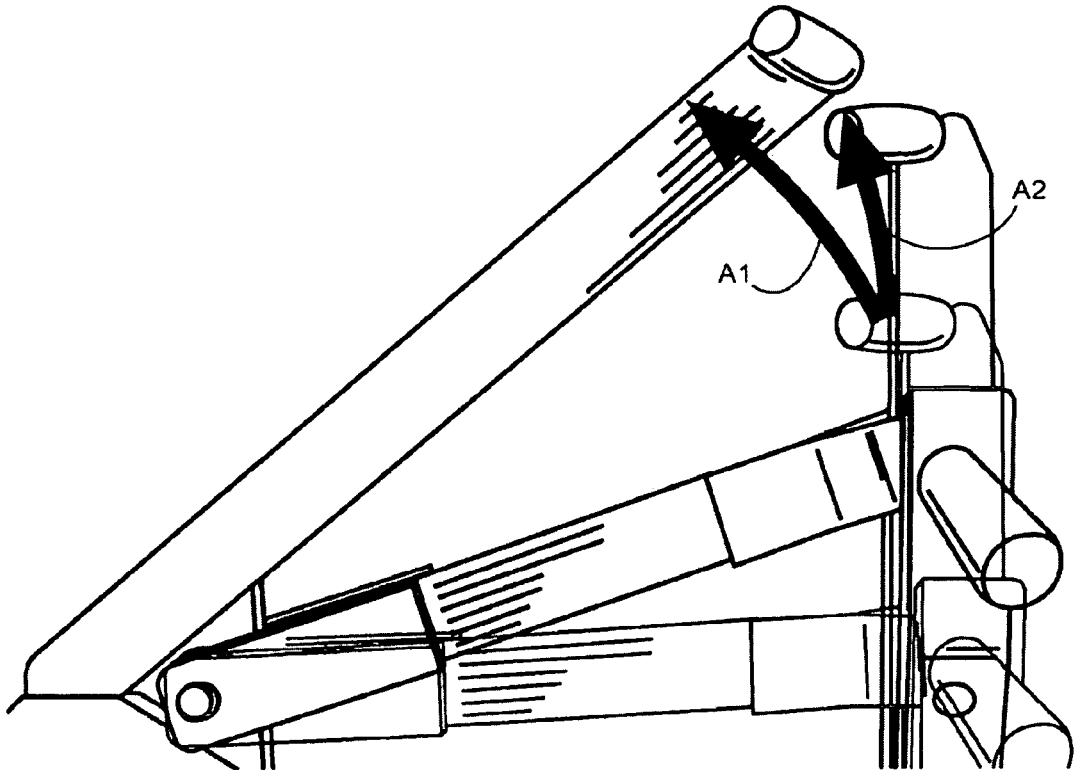
FIG. 6 is a partially cut-away left side elevational view of a portion of the exercise apparatus of FIG. 1, illustrating the compound arc of increasing radius of curvature.

In another aspect, as seen in the accompanying figures, the first handle is positioned in a plane that bisects and is substantially normal to the base longitudinal axis $L_B$. The second handle 320, in one aspect, moves along a continuous compound arc of increasing radius of curvature. One of the advantages of having the second handle move along a continuous compound arc is that it produces a more natural motion for the exercise. This can be seen in FIG. 6, where A1 represents a simple arc as a function of distance from the first pivot point, and where A2 represents the actual path in which the second handle moves.

In yet another aspect, the second handle 320 further has an elongate member 340, which is connected to a portion of the weight rack at its first end 344. In order to have two pivot points about which the second handle will pivot, it is likely that there is also a connecting member 350 pivotally connected at its distal end 352 to the frame at the first pivot point. In this aspect, the proximal end 354 of the connecting member 350 is pivotally connected to a portion of the elongate member 340 at a second pivot point 360, such that the second handle 320 articulates about the respective first and second pivot point as it moves about and between the first position to the second position. In another aspect, the respective first and second pivot points pivot about substantially parallel pivot axes $A_{P1}$ and $A_{P2}$. Having two pivot points facilitates the continuous compound arc mentioned above. Additionally, in one aspect, as the second handle moves between the second position, the connecting member remains normal to the base so as not to produce significant torque on the second handle.

As can be seen in the figures, the weight rack, in one aspect, has a rack frame 312 and a plurality of weight bearing rods 314. The base of each weight bearing rod is connected to the rack frame 312 and, in one aspect, is connected to the rack frame substantially co-axial with the pivot axis $A_{P2}$ of the second pivot point 360. This alignment keeps the weight directly at the second pivot point and eliminates any additional moment arm that would be created if the weight bearing rods 314 were offset from the second pivot point 360. The second end 342 of the elongate member in this aspect is also connected to a portion of the rack frame. In one aspect, the second end 342 of the elongate member 340 is connected substantially at the center of the rack frame 312. The elongate member may also be co-planar with the frame 200. In yet another aspect, the rack frame 312 is substantially U-shaped. However, as one skilled in the art can appreciate, the rack frame may be any suitable shape, such as V-shaped.

The exercise apparatus may also comprise an elongate foot lever 400 to assist in initiating the movement of the weight assembly 300, and thus the second handle, in the direction of the first handle. In this aspect, the second end 404 of the elongate foot lever 400 underlies a lower portion of the weight assembly and a portion of the elongate foot lever that is closer to the second end 404 than the first end 402 is connected to a portion of the frame 200 at a frame pivot point 410. In use, putting a downward first force on the first end 402 exerts an upward second force on the second end which is greater than the first force, thereby lifting the weight assembly and articulating the second handle to a position proximate the first handle 210. Additionally, in one aspect a portion of the elongate foot lever is connected to the base 100 by a bias device 420, such as a spring, in order to return the first end back to its resting position.

Optionally, in one aspect, the base has a top face 110 that is substantially planar and is at least partially covered by a deck 120. If the exercise apparatus is not secured to the floor in some manner, it is possible for users to lift portions of the apparatus off of the ground during use. Putting a deck 120 on the top face 110 of the base enables the user to place his feet on the deck, making it nearly impossible to lift the apparatus off the ground during use. The deck may comprise steel, aluminum, wood, or other sufficiently rigid material and connect to the frame in any conventional manner, such as welding, bolting, and the like.

In another aspect, the lower portion of the weight assembly 300 comprises a cushioning pad 370, such that when the second handle 320 is moved back into the first position, it is prevented from impacting against the base 100 and/or the elongate foot lever 400 and causing damage and noise. To that end, in this aspect, the second end of the elongate foot lever underlies a lower portion of cushioning pad 370. In one aspect, the cushioning pad comprises rubber, however, it may, for example, comprise wood, plastic, or other resilient material.

As one skilled in the art can appreciate, the material of construction may comprise various options. For example, the major components, such as the frame, base, and weight assembly may comprise steel, aluminum, or other sufficiently rigid and strong material. These components may be joined or connected in various conventional manners. For example and not meant to be limiting, the frame may be constructed by welding the pieces together, bolting, or any other sufficiently permanent joining means. In another aspect, the pivot points may comprise bearing systems, lubricated pins, or other known rotational connectors.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims.

Moreover, although specific terms are employed herein, as well as in the claims which follow, they are used only in a generic and descriptive sense, and not for the purposes of limiting the described invention, nor the claims which follow.

I claim:

1. An exercise apparatus, comprising:

a base having a base longitudinal axis;

a frame mounted thereon the base and comprising a first handle extending upwardly from the frame and spaced above the base;

a weight assembly comprising at least one weight rack for temporary mounting of exercise weights thereon and a second handle that extends upwardly away from the weight rack, and wherein the weight assembly is pivotally connected to the frame at a first pivot point and is configured to articulate about and between a first position in which the second handle is spaced from the first handle, and a second position in which the second handle is substantially adjacent the first handle, wherein the second handle moves along an arc that is in a plane that bisects and is substantially normal to the base longitudinal axis, and wherein the second handle moves along a continuous compound arc of increasing radius of curvature.

2. The exercise apparatus of claim 1, wherein the first handle is positioned in a plane that bisects and is substantially normal to the base longitudinal axis.

3. The exercise apparatus of claim 1, wherein the second handle further comprises an elongate member, wherein a first end of the elongate member is connected to a portion of the weight rack.

4. The exercise apparatus of claim 3, wherein the weight assembly further comprises a connecting member having a proximal end and a spaced distal end, wherein the distal end of the connecting member is pivotally connected to the frame at the first pivot point, wherein the proximal end is pivotally connected to a portion of the elongate member at a second pivot point, such that the second handle articulates about the respective first and second pivot points as it moves about and between the first position to the second position.

5. The exercise apparatus of claim 4, wherein the respective first and second pivot points pivot about substantially parallel pivot axes.

6. The exercise apparatus of claim 5, wherein the weight rack further comprises a rack frame and a plurality of weight bearing rods, wherein a base of each weight bearing rod is connected to the rack frame, and wherein a proximal end of the elongate member is connected to a portion of the rack frame.

7. The exercise apparatus of claim 6, wherein the rack frame is substantially U-shaped.

8. The exercise apparatus of claim 7, wherein the proximal end of the elongate member is connected substantially at the center of the rack frame.

9. The exercise apparatus of claim 8, wherein the elongate member and the frame are substantially co-planar.

10. The exercise apparatus of claim 6, wherein the base of each weight bearing rod is connected to the frame substantially co-axial with the pivot axis of the second pivot point.

11. The exercise apparatus of claim 1, further comprising an elongate foot lever having a first end and a second end, wherein the second end of the elongate foot lever underlies a lower portion of the weight assembly, and wherein a portion of the elongate foot lever that is closer to the second end than the first end is connected to a portion of the frame at a frame pivot point such that putting a downward first force on the first end exerts an upward second force on the second end which is greater than the first force, thereby lifting the weight assembly and articulating the second handle to a position proximate the first handle.

12. The exercise apparatus of claim 1, wherein the base has a top face that is substantially planar and is at least partially covered by a deck.

13. The exercise apparatus of claim 11, wherein the lower portion of the weight assembly comprises a cushioning pad, and wherein the second end of the foot lever underlies a lower portion of cushioning pad.

* * * * *